US005199897A

United States Patent [19]

Hashiguchi

[11] Patent Number: 5,199,897

[45] Date of Patent: Apr. 6, 1993

[54] ELECTRICAL CONNECTORS

[75] Inventor: Osamu Hashiguchi, Tokyo, Japan

[73] Assignee: Japan Aviation Electronics Industry, Ltd., Tokyo, Japan

[21] Appl. No.: 947,780

[22] Filed: Sep. 18, 1992

Related U.S. Application Data

[63] Continuation of Ser. No. 656,579, Feb. 15, 1991, abandoned.

[30] Foreign Application Priority Data

Mar. 15, 1990 [JP] Japan ..... 2-25027

[51] Int. Cl.[5] ..... H01R 13/627

[52] U.S. Cl. ..... 439/357; 439/350

[58] Field of Search ..... 439/350, 351, 352, 357, 439/358, 152, 153, 155, 159, 160

[56] References Cited

U.S. PATENT DOCUMENTS 4,002,389 1/1977 Mammel ..... 439/352
4,838,808 6/1989 Fujiura ..... 439/357
4,915,642 4/1990 Lin et al. ..... 439/352
4,954,097 9/1990 Sekiguchi ..... 439/352
4,961,711 10/1990 Fujiura et al. ..... 439/357

*Primary Examiner*—Larry I. Schwartz
*Assistant Examiner*—Hiend Vu
*Attorney, Agent, or Firm*—Bierman and Muserlian

[57] ABSTRACT

An electrical connector including a plug part and receptacle part having means for locking the plug and receptacle parts each other is disclosed. The plug part includes a body, a front hood, a pair of resilient lock members, a slider having a pair of leg portions to be inserted into the front hood and a rear hood. The receptacle part is provided with a pair of ear portions each of which projects outwardly from the side thereof. One end of the resilient lock member is secured to the front hood and extends longitudinally along the leg portion having a recess and cam surface and other free end of the lock member is formed to engage with the ear of the receptacle part. The free end of the lock member can be engaged with or released from the ear portion by cooperating with the cam surface when the plug part is manipulated to remove the plug part from the receptacle part.

1 Claim, 3 Drawing Sheets

ELECTRICAL CONNECTORS

PRIOR APPLICATION

This application is a continuation of U.S. patent application Ser. No. 656,579 filed Feb. 15, 1991, now abandoned.

BACKGROUND OF THE INVENTION

1. Field of the Invention

This invention relates to electrical connectors including a plug part and a receptacle part and more particularly to an electrical connector having means for locking the plug part to the receptacle part each other.

2. Description of the Prior Art

It is generally known that an electrical connector including a plug part and a receptacle part and that the plug part is locked to the receptacle part when the plug part is inserted into the receptacle part.

Usually, means for locking the plug part to the receptacle part include resilient side levers having hook portions provided to both sides of the plug part and members provided to both sides of the receptacle part for engaging with the respective hook portions when the plug part is inserted into the receptacle part.

In order to release the locked plug part and the receptacle part, both levers must be manually operated to open the hook portions, and then the plug part must be longitudinally moved to disconnect from the receptacle part.

Accordingly, it has the disadvantages that it is impossible to remove the plug part from the receptacle part when the portions other than the side levers are operated manually.

In addition to the above, according to the prior art, by reason that the electrical connector is provided with the side levers so as to project outwardly, the connector increases in its width or dimension so that the side levers may not be manipulated by one hand.

It is, therefore, an object of the present invention to provide an electrical connector in which the locking of a plug part and a receptacle part is capable to remove automatically without manipulating the locking means.

A further object is to provide an electrical connector having locking means which can reduce in width or dimension.

BRIEF DESCRIPTION OF THE DRAWINGS

The invention and its objects and advantages may be best understood with reference to the following detailed description of illustrative embodiments of the present invention shown in the accompanying drawings, wherein.

DESCRIPTION OF THE PREFERRED EMBODIMENTS

Figures 1, 2:
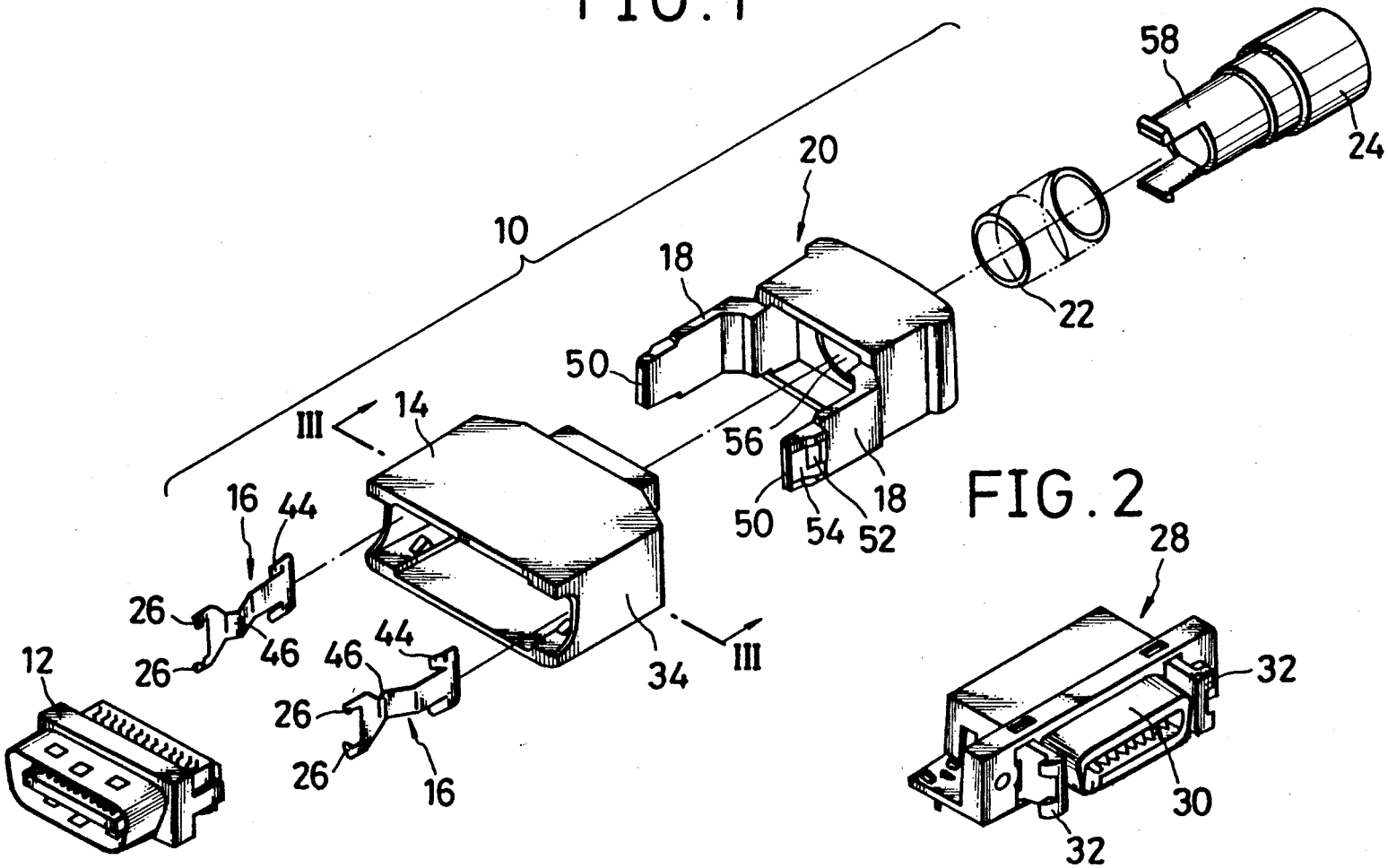
FIG. 1 is an exploded view of one embodiment of a plug part of the connector in accordance with the present invention.
FIG. 2 is a schematic perspective view of a receptacle part of the connector.

Referring more particularly to the drawings, FIG. 1 shows a plug part 10 of the present invention. The plug part 10 includes a connector body 12 to which a plurality of contact elements are arranged, a front hood 14 for mounting the connector body 12, a pair of resilient lock members 16 for fixedly securing the connector body 12 to the inside of the front hood 14, a slider 20 having a pair of leg portions 18 to be inserted into the front hood 14, and a rear hood 24 which may be slidably mounted by a coil spring 22 in the slider 20.

Figure 3:
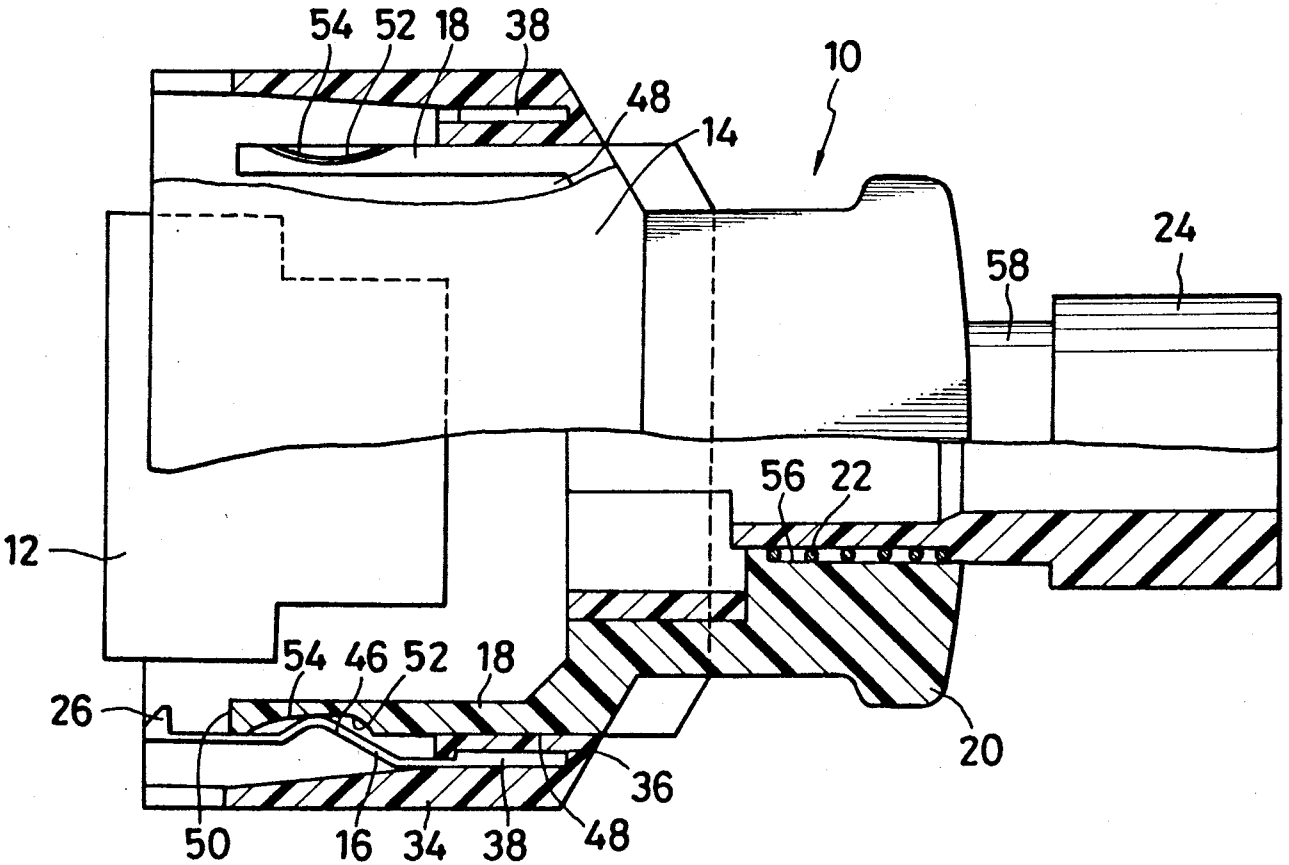
FIG. 3 is an enlarged sectional view taken on line III—III of FIG. 1, which portions are removed for illustrating lock mechanism of the present invention in detail.

FIG. 3 is a plan view, partly broken away to show inner construction, of the plug part 10 of the present invention in which all portions mentioned above are combined.

A plurality of conductors in a cable (not shown) are passed through the rear hood 24 and connected with the contact elements in the connector body 12. And then the body 12 may be mounted in the front hood 14 as usual.

Prior to mount the connector body 12 in the front hood 14, one end of each of a pair of resilient lock members 16 is secured to the inner sidewall of the front hood 14.

Figure 4:
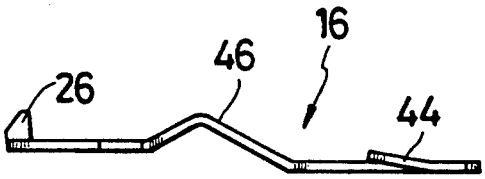
FIG. 4 is a side view of a resilient lock member of the present invention.
Figure 5:
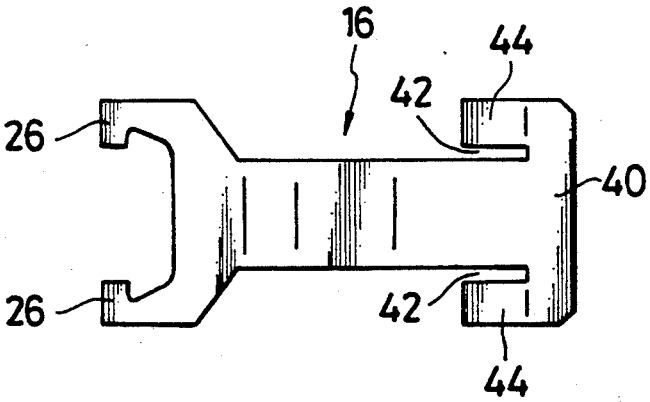
FIG. 5 is a plan view of the resilient lock member shown in FIG. 4.

The resilient lock member 16 is made of a resilient, relatively thin metal sheet, and as shown in FIGS. 4 and 5, one end of which is formed in Y-shaped configuration having a pair of tip portions which are respectively bent in inward so as to form hook portion 26.

On the other hand, as shown in FIG. 2, a receptacle part 28 has a pair of ear portions 32 at both sides of an end portion 30 of the receptacle part 28 in order to engage them with the respective hook portions 26 of the lock member 16.

The resilient lock member 16 of the plug part 10 is secured to the front hood 14 at he end 40 opposed to the hook portion 26. To this end, as shown in FIG. 3, a groove 38 is formed in each of the shoulder portion 36 of the inner wall 34 of the front hood 14 and as shown in in FIG. 5, the end 40 opposed to the hook portion 26 of the resilient lock member 16 is formed in T-shaped configuration having a pair of tabs 44 each of which are separated by a slot 42 from the main body of the lock member 16. As shown in FIG. 4, a free end of each of the tabs 44 is slightly inclined upwards. Consequently, when the tabs 44 are inserted into the groove 38 in the front hood 14, the resilient lock member 16 can be supported thereto by resilience of the tab 44.

An intermediate portion 46 between the hook portion 26 and the end 40 of the resilient lock member 16 is formed in a revised V-shaped configuration so as to project into the inside of the front hood 14, as shown in FIG. 4.

The slider 20 having a pair of leg portions 18 is combined with the front hood 14 by inserting the leg portions into the respective openings 48 formed in the shoulder portion 36 and guiding along the respective inner walls 34 of the front hood 14. A free end 50 of each of the leg portions 18 is extended over the revised V-shaped portion 46 of the resilient lock member 16 and terminates at before the hook portion 26 of the resilient lock member 16.

Each of the leg portions 18 of the front hood 20 is provided with a recess 52 for receiving the revised V-shaped portion 46 of the resilient lock member 16 and the outer surface between the recess 52 and the free end 50 of the leg portion 18 is curved to move the hook portion 26 outwardly by contacting with the revised V-shaped portion 46 of the resilient lock member 16 so as to disengage the hook portion 26 from the ear portion 32 of the receptacle part 28 when the the plug part 10 is withdrawn from the receptacle part 28.

The slider 20 has a cylindrical opening 56 into which the rear hood 24 is inserted. That is, an end portion 58 of the rear hood 24 is inserted into the cylindrical opening 56 for assembling the slider 20 and the rear hood 24. In order to move the slider 20 longitudinally with respect to the rear hood 24 when the rear hood 24 is assembled with the slider 20, the coil spring 22 is mounted around the end portion 58 of the rear hood 24 so as to press the slider 20 to the receptacle part 28. Further, to limit the moving or sliding stroke of the slider 20, a diameter of a desired portion of the rear hood 24 is larger than the diameter of the cylindrical opening 56 in the slider 20.

It will be understood from the foregoing that when the plug part 10 is inserted into the receptacle part 28, the hook portions 26 of each of the resilient lock member 16 engage with the respective ear portions 32 of the receptacle part 38 so that the plug part 28 and the receptacle part may be secured to each other.

In order to remove the plug part 10 from the receptacle part 28, it will be easily made by withdrawing the slider 20 outwardly. Then, the slider 20 can move against the action of the coil spring 22 and the leg portion 18 in the front hood 14 can be moved longitudinally. Consequently, the revised V-shaped potion 46 of the resilient lock member 16 in the recess 52 can be moved outwardly along the curved surface 54 of the leg portion 18, and then the lock portion 26 of the resilient lock member 16 moves outwardly so as to release the engagement of the hook portions 26 with the respective ear portions 32 of the receptacle part 28.

According to the present invention, the plug part 10 is conventionally assembled to the receptacle part 28 and it is possible to remove the plug part 10 from the receptacle part 20 by pulling out the slider 20 of the plug part 10.

Changes in construction will occur to those skilled in the art and various apparently different modifications and embodiments may be made without departing from the scope of the present invention. The matter set forth in the foregoing description and the accompanying drawings is offered by way of illustration only.

What is claimed is:

1. An electrical connector comprising a plug part, a receptacle part having a pair of ear portions each of which projects outwardly from the side thereof, said plug part including a body having a plurality of contact elements for connecting with conductors in a cable, a front hood for receiving said body, a pair of resilient lock members to secure to said front hood so as to extend along each side of said body within said front hood, a slider having a pair of legs which can be inserted into said hood in connection with said resilient lock members, one end each of which is formed as a hook for engaging with a respective said ear portion, a rear hood to be inserted in said slider, said resilient lock members each being provided with a curved portion at an intermediate portion thereof, and said each leg being provided with a recess for receiving said curved portion of said resilient lock member and a curve surface for cooperating with said curved portion of said resilient lock member whereby said plug portion can be easily removed from said receptacle part.

* * * * *